United States Patent [19]

Funazawa et al.

[11] 4,110,970

[45] Sep. 5, 1978

[54] WATER-PROOF WATCH CASE

[75] Inventors: Masakazu Funazawa, Tokorozawa; Osamu Matsumura, Chofu, both of Japan

[73] Assignee: Citizen Watch Company Limited, Tokyo, Japan

[21] Appl. No.: 738,204

[22] Filed: Nov. 3, 1976

[30] Foreign Application Priority Data

Nov. 11, 1975 [JP] Japan ..... 50-152627[U]
Dec. 1, 1975 [JP] Japan ..... 50-162709[U]

[51] Int. Cl.[2] ..... G04B 37/08
[52] U.S. Cl. ..... 58/90 R; 58/88 R
[58] Field of Search ..... 58/88 R, 88 C, 90 R, 58/91, 94

[56] References Cited

U.S. PATENT DOCUMENTS

| | | | |
|---|---|---|---|
| 3,355,875 | 12/1967 | Jeanmond | 58/91 |
| 3,479,771 | 11/1969 | Steimann | 58/90 R |
| 3,733,807 | 5/1973 | Nozawa | 58/90 R |
| 3,817,025 | 6/1974 | Siegrist | 58/90 R |
| 3,822,546 | 7/1974 | Nozawa | 58/90 R |
| 3,828,549 | 8/1974 | Nozawa et al. | 58/90 R |

FOREIGN PATENT DOCUMENTS

| | | | |
|---|---|---|---|
| 427,660 | 7/1967 | Switzerland | 58/90 R |

*Primary Examiner*—Robert K. Schaefer
*Assistant Examiner*—Vit W. Miska
*Attorney, Agent, or Firm*—Frank J. Jordan

[57] ABSTRACT

A water-proof watch case which comprises a case body having a shoulder and an inwardly facing annular recess, a watch movement having an outwardly extending flange placed on the shoulder of the case body, a sealing ring having an outwardly extending annular projection fitted to the annular recess of the case body and holding the flange on the shoulder, and a bezel having a downwardly extending projection press fitted to an inner wall of the sealing ring.

17 Claims, 10 Drawing Figures

WATER-PROOF WATCH CASE

This invention relates in general to water-proof watch cases and, more particularly, to a watch case structure adapted to be opened from the upper side.

In conventional water-proof watch cases, it has heretofore been proposed to provide a bezel adapted to receive a glass plate. The bezel has a stepped portion or shoulder for receiving the glass plate. Further, the bezel is formed with a downwardly or axially extending cylindrical projection. The outer diameter of the cylindrical projection is smaller than the corresponding inner diameter of a case body. A sealing ring is disposed between the cylindrical projection of the bezel and the inner diameter of the case body to provide a sealing effect therebetween. It has been a common practice to press the cylindrical projection of the bezel into the inner diameter of the sealing ring. In this case, since the sealing ring is merely disposed in the inner diameter portion of the case body and is not secured thereto, frequent replacements of the sealing ring are required each time the bezel is removed from the case body because the sealing ring is displaced from the case body in a distorted condition due to its inherent configuration. In the conventional watch cases, further, a case ring is mounted within the inner diameter of the case body and held in position by the bottom wall of the sealing ring, and a watch movement is supported by the case ring. A problem is encountered with this prior art in that the bezel can not be held in place especially when the watch case is subjected to impact shocks and tends to move apart from the case body when the impact shocks are great. Thus, the watch movement is liable to be damaged due to these causes. Attempts have been made to mount the watch movement directly onto the case body with the use of suitable fastening means such as screws. The use of the screws makes it necessary to dispose the watch movement into the case body from the bottom side thereof and, therefore, a back cover of a larger diameter is required to be detachably mounted onto the case body. In this case, it is required that the case body be provided with an undesirable engaging portion of a larger size by which it becomes difficult to make the case body thinner. Another drawback is that the screws are required to be frequently manipulated during assembling and disassembling operations and thus it is not only difficult to perform assembling or disassembling of the watch movement to the case body but also it is time consuming.

It is, therefore, an object of the present invention to provide an improved water-proof watch case which overcomes the shortcomings encountered in the prior art.

It is another object of the present invention to provide a water-proof watch case which is easy to assemble and disassemble.

It is another object of the present invention to provide a water-proof watch case having an increased shock resistant properties.

It is still another object of the present invention to provide a water-proof watch case composed of a sealing means having an increased strength and specific structure by which the watch case has improved water-proof qualities even after the watch case is subjected to several assembling and disassembling operations.

It is a further object of the present invention to provide a water-proof watch case which enables a fine view to be obtained because it allows the case body thinner.

These and other objects, features and advantages of the present invention will become more apparent from the following description when taken in conjunction with the accompanying drawings, in which.

Figure 1:
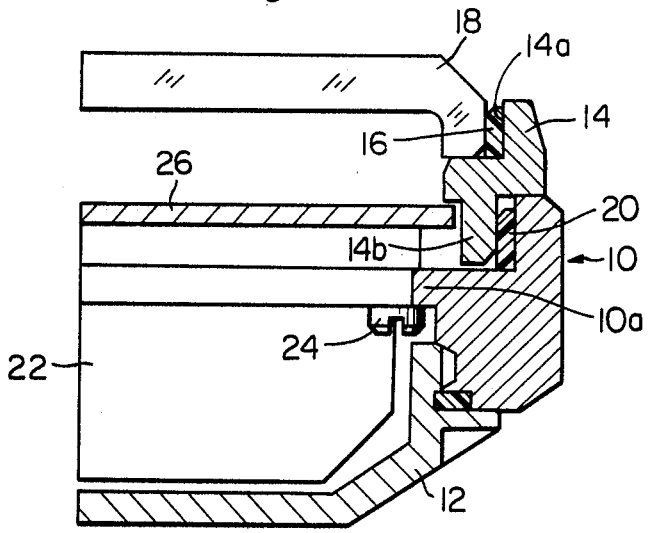
FIG. 1 is a cross sectional view of a prior art watch case.

Referring now to FIG. 1, there is shown in cross section a conventional structure of a watch case. As shown, the watch case comprises a case band 10 and a back cover 12 secured thereto. A bezel 14 has an annular shoulder **14*a* for receiving a glass plate 18. The outer diameter of the glass plate 18 is slightly smaller than the inner diameter of the bezel 14 to accomodate a sealing ring member 16 in a space defined therebetween. The bezel 14 also has a cylindrical or annular projection 14*b* downwardly or axially extending therefrom. The outer diameter of the projection 14*b* is smaller than the corresponding inner diameter of the case band 10. This provides a space to receive a cylindrical sealing ring 20, which is disposed between the case band 10 and the cylindrical projection 14*b* of the bezel 14. After the glass plate 18 is press fitted to the bezel 14, it is press fitted to the sealing ring 20. The case band 10 is formed with an inwardly projecting flange portion 10*a*, to which a watch movement 22 is secured by screws 24**.

With the structure mentioned above, since the sealing ring 20 is formed in cylindrical shape, it is liable to move apart from the case band 10 together with the bezel 14 when the bezel 14 and the case band 10 are disassembled from each other. In this case, the sealing ring 20 tends to be distorted and can not be used again when the bezel 14 is assembled to the case band 10. In addition, the use of the screws 24 makes it difficult to assemble and disassemble the watch movement 22 to and from the case band 10 as previously discussed.

Figure 2:
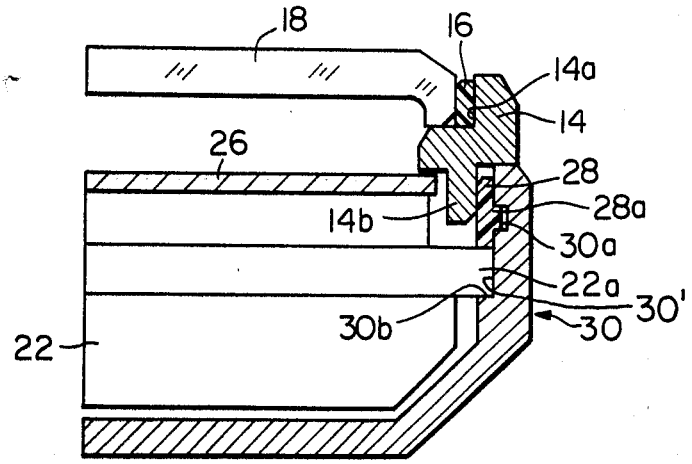
FIG. 2 is a cross section of a preferred embodiment of a watch case according to the present invention.

FIG. 2 shows a preferred embodiment of a watch case embodying the present invention which can solve the problems encountered in the prior art, with like parts bearing the same reference numerals as those used in FIG. 1. In FIG. 2, a sealing ring 28 made of a relatively hard, flexible material harder than the conventional rubber sealing ring, i.e., polytetrafluoroethylene known as a "Teflon", includes an axially extending annular body held at its outer periphery is pressured contact with an annular wall 30' of a case body 30. The annular body is formed at its outer periphery with an outwardly extending annular projection 28*a* by which the strength of the sealing ring 28 is increased. The annular projection 28*a* of the sealing ring 28 is fitted into an inwardly facing annular recess 30*a* formed in the case body 30 made of a single metallic piece serving as a case band and a back cover, and the sealing ring 28 is fixed in place such that it is prevented from being moved in an axial direction. The case body 30 may be formed with an access opening of a smaller diameter to replace a battery (not shown) or to make it possible to remove the stem of a crown (not shown) from the case body and include a back cover of a smaller size to cover the access opening. The case body 30 is also formed with a shoulder portion 30*b*, on which an outwardly extending flange 22*a* of the watch movement 30 is placed. The bottom wall of the sealing ring 28 abuts against the upper wall of the flange 22*a* of the watch movement 22 to hold the watch movement 22 in fixed place.

With the arrangement mentioned above, the glass plate 18 is press fitted to the sealing ring 16 engaging the shoulder 14*a* of the bezel 14. Thus, the glass plate 18 is fixedly supported by the bezel 14. It is to be noted that the sealing ring 16 serves as a water-proof material at the periphery of the glass plate 18. The flange 22*a* of the watch movement 22 is placed onto the shoulder portion 30*b* of the case body 30 and, thereafter, the sealing ring 28 is mounted in the inner wall of the case body 30 such that the annular projection 28*a* is fitted to the corresponding annular recess 30*a* of the case body 30. In this condition, the bottom wall of the sealing ring 28 abuts against the upper wall of the flange 22*a* of the watch movement to hold it in a fixed position. Subsequently, the bezel 14 together with the glass plate 18 is press fitted to and compress the sealing ring 28 against the annular wall 30' of the case body 30 to provide a water-tight sealing effect therebetween; and, consequently, fixedly supported by the case body 30 by the action of the sealing ring 28. As previously noted, since the sealing ring 28 is fixed in place by the projection 28*a* engaging the corresponding recess 30*a* of the case body 30, its axial movement and distortion are prevented due to the action of the projection 28*a* even when the bezel 14 is assembled to and disassembled from the case body 30. Thus, the need for frequent replacement of the sealing ring 28 can be avoided. Another advantage is that the watch case has an increased shock resisting property because the axial movement of the sealing ring 28 is prevented in a highly reliable manner by the action of the projection 28*a*.

Figure 3:
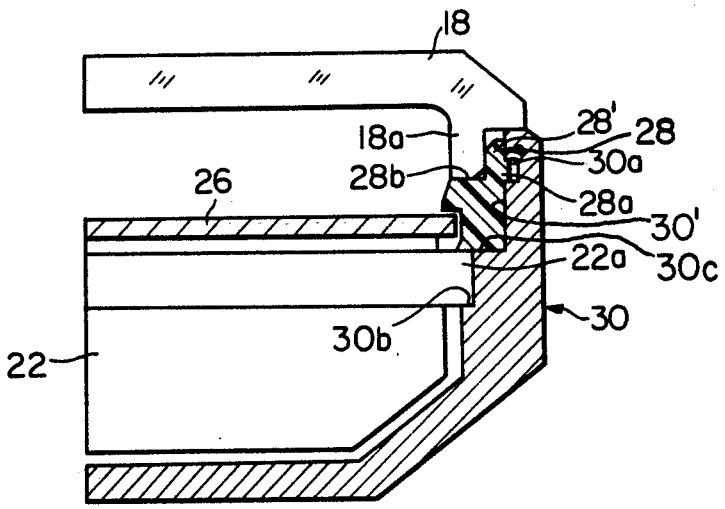
FIG. 3 is a cross section of another preferred embodiment of a watch case according to the present invention.

Another preferred embodiment of the watch case embodying the present invention is illustrated in FIG. 3. In this illustrated embodiment, the bezel 14 is dispensed with and the glass plate 18 is directly supported by the case body 30. To this end, the glass plate 18 is formed with an axially or downwardly extending annular or cylindrical projection 18*a*, and the sealing ring 28 includes an upper, annular ring portion 28' and radially extending annular shoulder portion 28*b*. The case body 30 has a radially extending annular shoulder 30*c* axially spaced from the shoulder 30*b* by an amount substantially equal to the thickness of the flange 22*a*. The projection 18*a* of the glass plate 18 is press fitted to the sealing ring 28 to compress the annular ring portion 28' to provide a water-tight sealing effect between the glass 18 and the case body 30 and abuts against the shoulder portion 28*b* formed on the sealing ring 28 to urge the bottom wall of the sealing ring 28 engaging the shoulder 30*c* toward the flange 22*a* of the watch movement 22 to retain the flange 22*a* in a fixed place on the shoulder 30*b*. In this manner, the glass plate 18 is fixedly supported by the case body 30 by the action of the sealing ring 28, by the action of which the watch movement 22 is also held in a fixed position.

Figure 4:
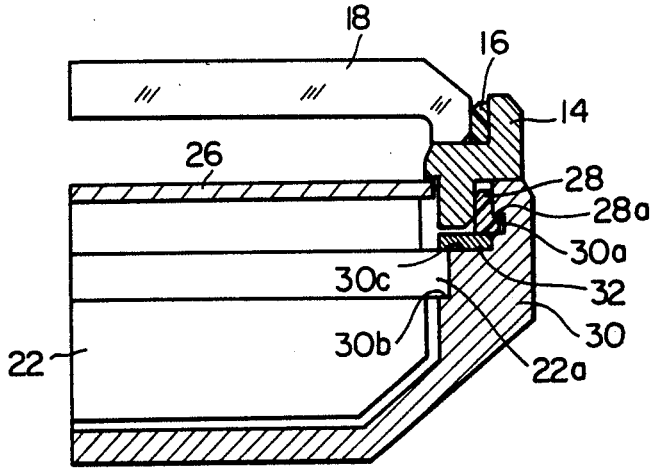
FIG. 4 is a cross section of still another preferred embodiment of a watch case according to the present invention.

FIG. 4 shows another preferred embodiment of the watch case according to the present invention which is similar in construction with that of FIG. 2. This embodiment differs from that of FIG. 2 in that retaining ring 32 is placed on the shoulder 30*c* of the case body 30. The bottom wall of the sealing ring 28 abuts against the upper wall of the retaining ring 32, which in turn holds the flange 22*a* of the watch movement 22 in place.

Figure 5:
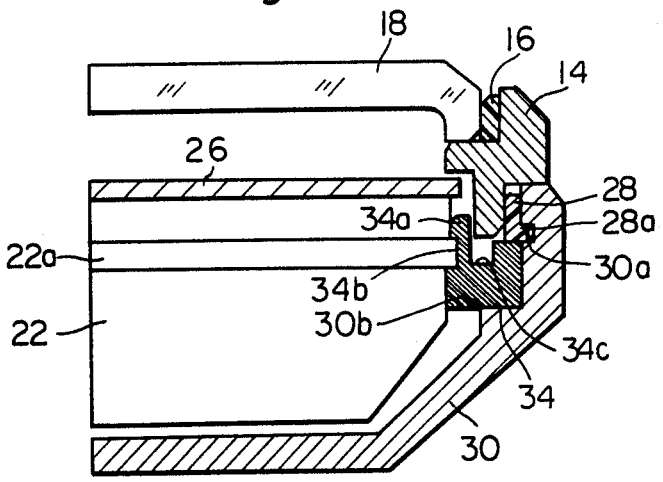
FIG. 5 is a cross section of a further preferred embodiment of a watch case according to the present invention.

FIG. 5 shows another preferred embodiment of the watch case according to the present invention. In this illustrated embodiment, the flange 22*a* of the watch movement 22 is fixedly supported by an annular supporting ring or frame member 34, which is fixed in place between the shoulder 30*b* of the case body 30 and the bottom wall of the sealing ring 28. The annular supporting ring 34 has a plurality of axially extending flange segments 34*a* formed with holding recesses 34*b*, respectively, to hold the flange 22*a* of the watch movement 22 by snap action. The annular supporting ring 34 may be composed of a flexible material, preferably a flexible plastic such as polyacetal or nylon (polyamid). The flexibility of the supporting ring 34 is enhanced by providing an annular groove 34*c* adjacent the flange segments 34*a*. The supporting ring 34 may be provided with a plurality of outwardly extending projections adapted to engage the corresponding recesses of the case body to prevent the rotation of the supporting ring 34 with respect to the case body 30.

Figure 6:
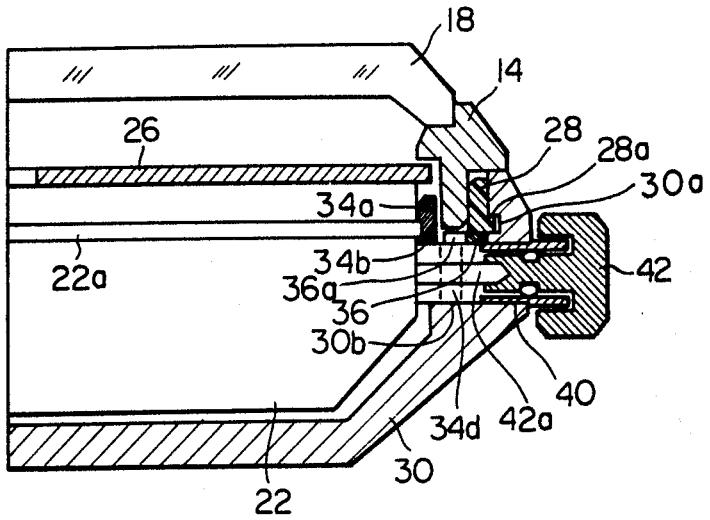
FIGS. 6 and 7 shows a still further embodiment of a watch case according to the present invention.
Figure 7:
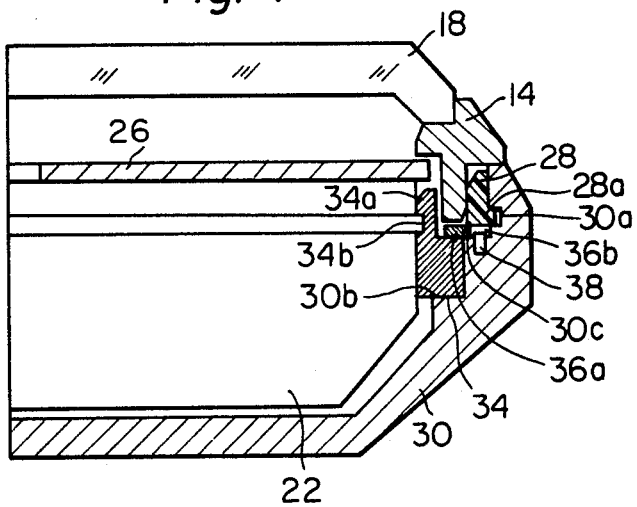
Figure 8:
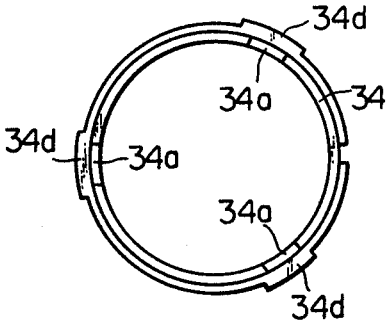
FIG. 8 is a plan view of a supporting ring forming part of the watch case shown in FIGS. 6 and 7.

FIGS. 6 to 9 show still another preferred embodiment of the present invention. In this illustrated embodiment, the sealing ring 16 is dispensed with, and the glass plate 18 is directly fixed to the bezel 14 by means of an adhesive. In addition, a pressure ring 36 is placed on a shoulder 30*c* of the case body 30 to hold the supporting ring 34 in a fixed place by the action of the sealing ring 28. As shown in FIGS. 6 and 8, the supporting ring 34 has a plurality of upwardly extending flange segments 34*a*, and a plurality of outwardly extending projections 34*d*. The pressure ring 36 has a plurality of inwardly extending projections 36*a* formed at circumferentially spaced positions corresponding to the positions of the flange segments 34*a* of the supporting ring 34. The pressure ring 36 also has a notch 36*b* formed at the outer periphery, with which a stop pin 38 secured to the case body 30 engages as shown in FIG. 7 so that the rotation of the pressure ring 36 with respect to the case body 30 is prevented. Thus, the pressure ring 36 is normally urged by the bottom wall of the sealing ring 28 to hold the upper surfaces of the projections 34*d* of the supporting ring 34. The supporting ring 34 may be rotated to a position such that the projections 34*d* of the supporting ring 34 are brought out of engagement with the projections 36*a* of the pressure ring 36 and, therefore, the watch movement 22 can be readily moved away from the case body 30 from the upper side.

Turning to FIG. 6, the case body 30 is formed with a transverse bore to which a pipe 40 is fitted. A crown 42 is rotatably supported by the pipe 40 and a stem 42*a* is connected to the crown 42 and a time setting mechanism (not shown) of the watch movement 22 to permit time corrections or time settings.

Figure 9:
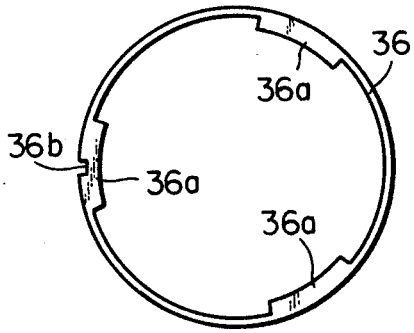
FIG. 9 is a plan view of one example of a pressure ring forming part of the watch case shown in FIGS. 6 and 7.
Figure 10:
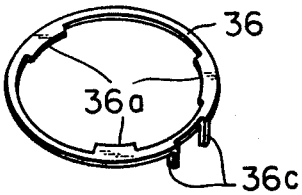
FIG. 10 is a perspective view of another example of the pressure ring forming part of the watch case shown in FIGS. 6 and 7.

FIG. 10 shows a modification of the pressure ring 36 shown in FIG. 9. In this modification, the pressure ring 36 is formed with a pair of downwardly extending projections 36*c*. The pressure ring 36 thus arranged is placed on the shoulder 30*c* of the case body 30 such that the pipe 40 extends through the projections 30*c* whereby the pressure ring 36 is held in fixed place and its rotation is prevented.

It will now be appreciated from the foregoing description that in accordance with the present invention a flexible sealing ring to be interposed between a bezel or glass plate and a case body has at its outer periphery an annular projection and the case body has a corresponding annular recess to fit therein the annular projection of the sealing ring whereby the axial movement of the sealing ring can be prevented to allow easy assembling and disassembling of the bezel or glass plate and the case body.

It should also be understood that since a watch case of the present invention has a watch movement held in place by means of a bottom wall of a sealing ring without the use of fastening means such as screws, easy assembling and disassembling can be obtained and the number of component parts can be reduced to increase the internal spacing of the watch case.

It should further be noted that in accordance with the present invention the appearance of a watch case can be remarkably improved because a case body of the watch case can be made thinner due to its inherent construction and arrangement previously described.

While the present invention has been shown and described with reference to particular embodiments by way of example, it should be born in mind that various other changes or modification can be made without departing from the scope of the present invention. For example, a case body may have an opening to which a suitable cover of a smaller size is detachably mounted for the purpose as already noted hereinabove. In addition, it is to be noted that the projection 28*a* and the recess 30*a* need not necessarily be formed in an annular shape and may be party formed on the sealing ring 28 and the case body 30.

What is claimed is:

1. A water-proof watch case having a watch movement formed at its outer periphery with a flange, comprising:

a case body including an axially extending annular wall formed with a radially extending annular shoulder adapted to support the flange of said watch movement, and an inwardly facing annular recess formed on said annular wall;

a relatively hard, flexible sealing ring including an axially extending annular body held at its outer periphery in pressured contact with the annular wall of said case body, and an outwardly extending annular projection formed on the outer periphery of said annular body and engaging with the annular recess of said case body to prevent an axial displacement of said sealing ring relative to said case body, said annular body having a bottom end engaging with an upper surface of the flange of said watch movement to retain said flange in a fixed place on the annular shoulder of said case body; and a bezel for receiving a glass plate and including a lower end formed with a downwardly extending annular portion press-fitted to and compressing said sealing ring against the annular wall of said case body to provide a water-tight sealing effect therebetween.

2. A water-proof watch case according to claim 1, further comprising an annular sealing member compressed between said glass plate and said bezel.

3. A water-proof watch case having a watch movement formed at its outer periphery with a flange, comprising:

a case body including an axially extending annular wall, radially extending first and second annular shoulders formed on said annular wall, and an inwardly facing annular recess formed on said annular wall at a position axially spaced from said second annular shoulder, said first annular shoulder being axially spaced from said second shoulder by an amount substantially equal to the thickness of the flange of said watch movement to support said flange;

a relatively hard, flexible sealing ring including an axially extending annular body held at its outer periphery in pressured contact with the annular wall of said case body, said annular body including an upper, annular ring portion, a radially extending annular shoulder formed adjacent said annular ring portion, an outwardly extending annular projection formed at the outer periphery of said annular body and engaging with the annular recess of said case body to prevent an axial displacement of said sealing ring relative to said case body, and a bottom end engaging with said second annular shoulder of said case body and the flange of said watch movement to retain said flange in a fixed place on said first annular shoulder of said case body; and a glass plate including an axially extending annular projection press-fitted to and compressing the annular ring portion of said sealing ring against the annular wall of said case body to provide a water-tight sealing effect therebetween, said annular portion having its bottom end engaging the annular shoulder of said sealing ring to compress said annular body against the flange of said watch movement.

4. A water-proof watch case having a watch movement formed at its outer periphery with a flange, comprising:

a case body including a first shoulder adapted to support the flange of said watch movement, a second shoulder axially spaced from said first shoulder, and a recess facing inwardly of said case body;

a sealing ring including a projection outwardly extending from an outer periphery thereof and fitted to the recess of said case body, said sealing ring having a bottom wall for holding said flange in place on said shoulder of said case body;

a bezel for receiving a glass plate and including a downwardly extending projection press fitted to an inner wall of said sealing ring; and a retaining ring placed on said second shoulder of said case body and holding said flange in place by the action of said sealing ring.

5. A water-proof watch case according to claim 4, further comprising a sealing member compressed between said glass plate and said bezel.

6. A water-proof watch case according to claim 4, in which said sealing ring is made of a relatively hard, flexible material.

7. A water-proof watch case having a watch movement formed at its outer periphery with a flange, comprising:

a case body including an axially extending annular wall formed with a radially extending annular shoulder, and an inwardly facing annular recess formed on said annular wall;

a relatively hard, flexible sealing ring including an axially extending annular body held at its outer periphery in pressured contact with the annular wall of said case body, and an outwardly extending annular projection formed on the outer periphery of said annular body and engaging with the annular recess of said case body to prevent an axial displacement of said sealing ring relative to said case body, said annular body having a bottom end;

a bezel for receiving a glass plate and including a lower end formed with a downwardly extending annular portion press-fitted to and compressing said sealing ring against the annular wall of said case body to provide a water-tight sealing effect therebetween; and a supporting ring engaging at its bottom wall on the annular shoulder of said case body and retained in a fixed place by the bottom end of said sealing ring, said supporting ring having an annular recess to fixedly retain the flange of said watch movement.

8. A water-proof watch case according to claim 7, further comprising a sealing member compressed between said glass plate and said bezel.

9. A water-proof watch case according to claim 7, in which said sealing ring is made of a relatively hard, flexible material.

10. A water-proof watch case having a watch movement formed at its outer periphery with a flange, comprising:

a case body including a shoulder adapted to support the flange of said watch movement, and a recess facing inwardly of said case body;

a sealing ring including a projection outwardly extending from an outer periphery thereof and fitted to the recess of said case body, said sealing ring having a bottom wall for holding said flange in place on said shoulder of said case body; and a bezel for receiving a glass plate and including a downwardly extending projection press fitted to an inner wall of said sealing ring;

a supporting ring engaging at its bottom wall on the shoulder of said case body to fixedly support the flange of said watch movement; and a pressure ring disposed between said sealing ring and said supporting ring.

11. A water-proof watch case according to claim 10, in which said pressure ring has at least one axially extending projection to prevent rotation of said pressure ring with respect to said case body.

12. A water-proof watch case according to claim 10, further comprising a sealing member compressed between said glass plate and said bezel.

13. A water-proof watch case according to claim 10, in which said sealing ring is made of a relatively hard, flexible material.

14. A water-proof watch case according to claim 10, in which said glass plate is fixed to said bezel by an adhesive.

15. A water-proof watch case according to claim 10, further comprising a stop pin provided on said case body and engaging said pressure ring to prevent rotation thereof with respect to said case body.

16. A water-proof watch case according to claim 10, in which said supporting ring has a plurality of flange segments to fixedly support the flange of said watch movement.

17. A water-proof watch case according to claim 16, in which said supporting ring also has at its outer periphery a plurality of outwardly extending projections, and in which said pressure ring has a plurality of inwardly extending projections adapted to engage the outwardly extending projections of said supporting ring to fixedly support said supporting ring on the shoulder of said watch case.

* * * * *